US009279208B2

(12) United States Patent
Sul et al.

(10) Patent No.: US 9,279,208 B2
(45) Date of Patent: Mar. 8, 2016

(54) WASHING MACHINE HAVING TUB FIXING PART

(71) Applicant: SAMSUNG ELECTRONICS CO., LTD., Suwon-si (KR)

(72) Inventors: Nam Ki Sul, Suwon-si (KR); Kwang Min Chun, Seoul (KR); Jong Hun Sung, Suwon-si (KR); Hong Yeol Lee, Yongin-si (KR); Jung Sang Choi, Hwaseong-si (KR); Sang Young Kweon, Uiwang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/870,377

(22) Filed: Apr. 25, 2013

(65) Prior Publication Data

US 2013/0305789 A1 Nov. 21, 2013

(30) Foreign Application Priority Data

May 18, 2012 (KR) ..... 10-2012-0053194
Dec. 17, 2012 (KR) ..... 10-2012-0147687
Feb. 8, 2013 (KR) ..... 10-2013-0014283

(51) Int. Cl.
*D06F 37/26* (2006.01)
*D06F 39/00* (2006.01)

(52) U.S. Cl.
CPC ..... *D06F 37/264* (2013.01); *D06F 39/001* (2013.01)

(58) Field of Classification Search
CPC ..... D06F 37/26; D06F 39/00; D06F 37/264; D06F 39/001; A47L 15/4268; A47L 15/4255
USPC ..... D32/6; 68/139
See application file for complete search history.

(56) References Cited

U.S. PATENT DOCUMENTS 6,062,790 A * 5/2000 Huang ..... F16B 5/02 411/107
D575,463 S 8/2008 Mao et al.
(Continued)

FOREIGN PATENT DOCUMENTS

DE 102005031488 B3 8/2006
EP 1602772 A1 12/2005
(Continued)

OTHER PUBLICATIONS

Extended European Search Report mailed Oct. 2, 2013 in corresponding European Application No. 13165363.6.
(Continued)

*Primary Examiner* — Michael Barr
*Assistant Examiner* — Rita Adhlakha
(74) *Attorney, Agent, or Firm* — Staas & Halsey LLP

(57) ABSTRACT

Provided is a washing machine that can maintain sufficient rigidity while reducing a thickness of a frame by improving the shape of beads disposed at the frame, the washing machine including: a cabinet; a tub that is disposed to accommodate washing water in the cabinet and has a fastening hole formed in a rear side of the tub; a tub fixing part that is provided in plural numbers at a rear side of the cabinet in a position corresponding to the fastening hole; a fixing member that is inserted into the tub fixing part and is fastened to the fastening hole so that the tub is fixed to the rear side of the cabinet; and beads that are provided in plural numbers at both sides of the cabinet so as to have a shape of grooves formed in a direction of an inner side of the cabinet.

8 Claims, 13 Drawing Sheets

(56) References Cited

U.S. PATENT DOCUMENTS

| | | | | |
|---|---|---|---|---|
| D642,753 | S | 8/2011 | Ha | |
| 2011/0227462 | A1* | 9/2011 | Bohm et al. | 312/204 |
| 2011/0234073 | A1 | 9/2011 | Thompson Salinas et al. | |

FOREIGN PATENT DOCUMENTS

| | | | |
|---|---|---|---|
| WO | WO 02/44459 | A1 | 6/2002 |
| WO | 2005/066408 | A1 | 7/2005 |
| WO | 2008/081493 | A2 | 7/2008 |
| WO | 2010/066653 | A1 | 6/2010 |
| WO | 2010/076134 | A1 | 7/2010 |

OTHER PUBLICATIONS

European Office Action issued Aug. 12, 2015 in corresponding European Patent Application No. 13165363.6.

* cited by examiner

WASHING MACHINE HAVING TUB FIXING PART

CROSS-REFERENCE TO RELATED APPLICATION

This application claims the benefit of Korean Patent Application No. 2012-0053194, filed on May 18, 2012, Korean Patent Application No. 2012-0147687, filed on Dec. 17, 2012, Korean Patent Application No. 2013-0014283, filed on Feb. 8, 2013 in the Korean Intellectual Property Office, the disclosure of which is incorporated herein by reference.

BACKGROUND

1. Field

Embodiments of the present invention relate to a washing machine having a structure in which a thickness of a cabinet may be reduced.

2. Description of the Related Art

A washing machine as a machine that washes clothes using power, generally includes a main body, a tub that is disposed to accommodate washing water in the main body, a drum that is rotatably installed in the tub, a motor for rotating the drum, and a door that is installed at an opening of the tub and opens/closes the opening.

A frame that constitutes the exterior and supports vibration and shock generated while the washing machine is transported or used, is installed at both sides of the main body.

The frame should have enough rigidity to support vibration and shock of the washing machine. To this end, a raw material, of which a thickness is more than a limited thickness, should be used.

Beads having various shapes are provided at the frame so as to satisfy sufficient rigidity with the limited thickness. It is difficult to reduce the thickness of the frame while maintaining sufficient rigidity using existing types of beads.

Also, if the thickness of a cabinet is reduced, a tub fixing part disposed at a rear side of the cabinet may be deformed due to a fixing member that is shaken by vibration and shock of the washing machine.

Thus, the shape of beads that may maintain sufficient rigidity while reducing the thickness of the frame, need to be provided. Also, the tub fixing part need to be improved so as to prevent deformation of the tub fixing part while reducing the thickness of the cabinet.

SUMMARY

Therefore, it is an aspect of the present invention to provide a washing machine that may maintain sufficient rigidity while reducing a thickness of a frame by improving the shape of beads disposed at the frame.

It is another aspect of the present invention to provide a washing machine having an improved structure in which a tub fixing part disposed to fix a tub to a rear side of a cabinet may be prevented from being deformed by vibration and shock of the washing machine.

Additional aspects of the invention will be set forth in part in the description which follows and, in part, will be obvious from the description, or may be learned by practice of the invention.

In accordance with one aspect of the present invention, there is provided a washing machine including: a cabinet that constitutes exterior; and a tub that is disposed to accommodate washing water in the cabinet and has a fastening hole formed in a rear side of the tub; a drum that is rotatably disposed in the tub; a tub fixing part that is provided in plural numbers at a rear side of the cabinet in a position corresponding to the fastening hole; a fixing member that is inserted into the tub fixing part and is fastened to the fastening hole so that the tub is fixed to the rear side of the cabinet; and beads that are provided at each of both sides of the cabinet so as to have a shape of grooves formed in a direction of an inner side of the cabinet, wherein the beads include first beads provided in one pair while being disposed in parallel to right and left edges of a side of the cabinet, second beads provided in one pair while being disposed in parallel to upper and lower edges of the side of the cabinet, and a connection part that connects both ends of the first beads and both ends of the second beads.

The beads may be provided in plural numbers at each of the both sides of the cabinet while being spaced apart from the right and left edges of the side of the cabinet and the upper and lower edges of the side of the cabinet by a predetermined interval, and may have a shape of grooves so that cross-sections of the beads are curve-shaped.

The grooves of the beads may have a semicircular shape in which a center of the beads is the deepest and the center of the beads may have a depth that is 8 to 10 times a thickness of both sides of the cabinet.

A thickness of both sides of the cabinet may be 0.7 mm or less.

The beads may have a depth of 4.0 to 10 mm with respect to a surface of both sides of the cabinet.

The beads may be disposed in a rectangular form.

The beads may be disposed in an oval form.

The connection part may be disposed in a round form.

The tub fixing part may include a circular hole into which the fixing member is inserted, protrusion beads that are disposed adjacent to the hole along a circumference of the hole, and reinforcement grooves that are disposed to extend from the hole toward an outer side of the hole in a direction of a radius of the hole and are provided in plural numbers in a radial form around the hole.

The tub fixing part may include a circular hole into which the fixing member is inserted, a circular bead that is disposed adjacent to the hole along a circumference of the hole and protrudes from an outer side of the cabinet convexly, radial beads that are provided in plural numbers in a radial form around the hole toward an outer side of the circular bead and protrude from the outer side of the cabinet convexly, and reinforcement grooves that are provided in plural numbers so as to extend from the hole to an outer side of the hole.

The fixing member may include a head that is disposed to have a larger diameter than a diameter of the hole so that the fixing member is not inserted into the hole, the head being fixed to the hole, a body that is disposed at a front side of the head to have a diameter corresponding to the hole and is inserted into the hole, and a fastening part that is disposed at a front side of the body and is fastened in a fastening hole disposed in a rear wall of the tub.

A convexly-protruding portion of the protrusion beads may have a round-shaped cross-section, and the protrusion beads and the hole may be connected by an obliquely inclined surface having a round-shaped cross-section.

The reinforcement grooves may extend up to an outer side of the beads and may have the same depths.

In accordance with another aspect of the present invention, there is provided a washing machine including: a cabinet that constitutes exterior; and a tub that is disposed to accommodate washing water in the cabinet and has a fastening hole formed in a rear side of the tub; a drum that is rotatably disposed in the tub; a tub fixing part that is provided in plural numbers at a rear side of the cabinet in a position corresponding to the fastening hole; a fixing member that is inserted into the tub fixing part and is fastened to the fastening hole so that the tub is fixed to the rear side of the cabinet; and beads that are provided at each of both sides of the cabinet so as to have a shape in which the beads protrude from an outer side of the cabinet, wherein the beads include first beads provided in one pair while being disposed in parallel to right and left edges of a side of the cabinet, second beads provided in one pair while being disposed in parallel to upper and lower edges of the side of the cabinet, and a connection part that connects both ends of the first beads and both ends of the second beads.

The beads may be provided in plural numbers at each of the both sides of the cabinet while being spaced apart from the right and left edges of the side of the cabinet and the upper and lower edges of the side of the cabinet by a predetermined interval, and protrude from the outer side of the cabinet so that cross-sections of the beads are curve-shaped.

The beads may be disposed in a rectangular form.

The connection part may be disposed in a round form.

In accordance with another aspect of the present invention, there is provided a washing machine including a frame disposed at both sides of a main body so as to constitute exterior, wherein the frame includes: first beads disposed at right and left edges of the frame in each pair in parallel and having a shape of grooves formed in a direction of an inner side of the frame; second beads disposed at upper and lower edges of the frame in each pair in parallel, connecting both ends of the first beads, and having a shape of grooves formed in the direction of the inner side of the frame; and a connection part that connects both ends of the first beads and both ends of the second beads and has a shape of grooves formed in the direction of the inner side of the frame, and the first beads and the second beads disposed in each pair may be provided in plural numbers so as to reinforce rigidity of the frame.

In accordance with another aspect of the present invention, there is provided a washing machine including: a cabinet that constitutes exterior; and a tub that is disposed to accommodate washing water in the cabinet and has a fastening hole formed in a rear side of the tub; a drum that is rotatably disposed in the tub; a tub fixing part that is provided in plural numbers at a rear side of the cabinet in a position corresponding to the fastening hole; and a fixing member that is inserted into the tub fixing part and is fastened to the fastening hole so that the tub is fixed to the rear side of the cabinet, wherein the tub fixing part includes a circular hole into which the fixing member is inserted, protrusion beads that are disposed adjacent to the hole along a circumference of the hole and protrude from an outer side of the cabinet convexly, and reinforcement grooves that are disposed to extend from the hole toward an outer side of the hole in a direction of a radius of the hole and are provided in plural numbers in a radial form around the hole.

In accordance with another aspect of the present invention, there is provided a washing machine including: a cabinet that constitutes exterior; and a tub that is disposed to accommodate washing water in the cabinet and has a fastening hole formed in a rear side of the tub; a drum that is rotatably disposed in the tub; a tub fixing part that is provided in plural numbers at a rear side of the cabinet in a position corresponding to the fastening hole; and a fixing member that is inserted into the tub fixing part and is fastened to the fastening hole so that the tub is fixed to the rear side of the cabinet, wherein the tub fixing part includes a circular hole into which the fixing member is inserted, a circular bead that is disposed adjacent to the hole along a circumference of the hole and protrudes from an outer side of the cabinet, protrusion beads that are provided in plural numbers in a radial form around the hole toward an outer side of the circular bead and protrude from the outer side of the cabinet convexly, and reinforcement grooves that are provided in plural numbers so as to extend from the hole toward an outer side of the hole.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
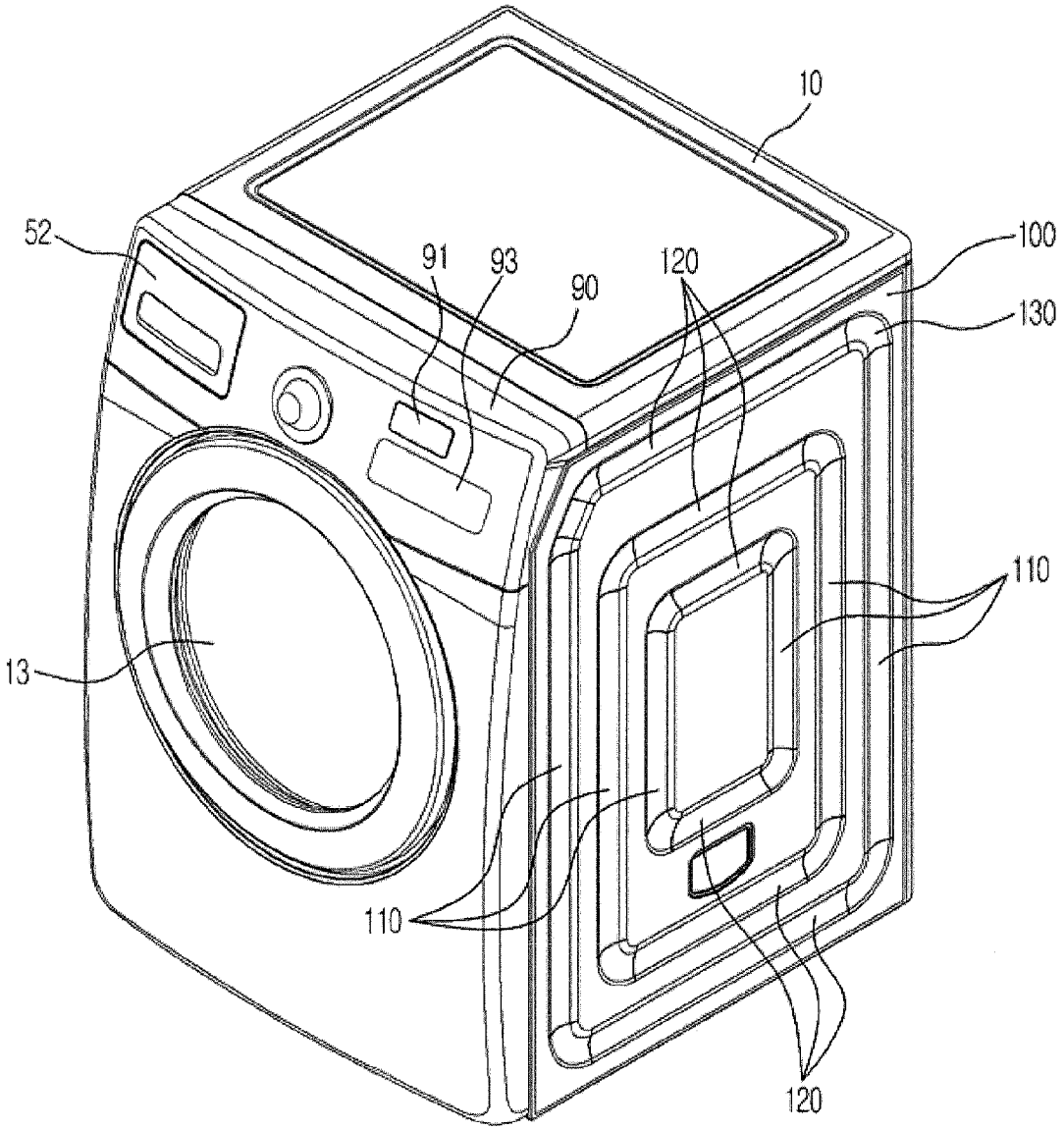
FIG. 1 is a perspective view illustrating a washing machine according to an embodiment of the present invention.

Reference will now be made in detail to the embodiments of the present invention, examples of which are illustrated in the accompanying drawings, wherein like reference numerals refer to like elements throughout.

Figure 2:
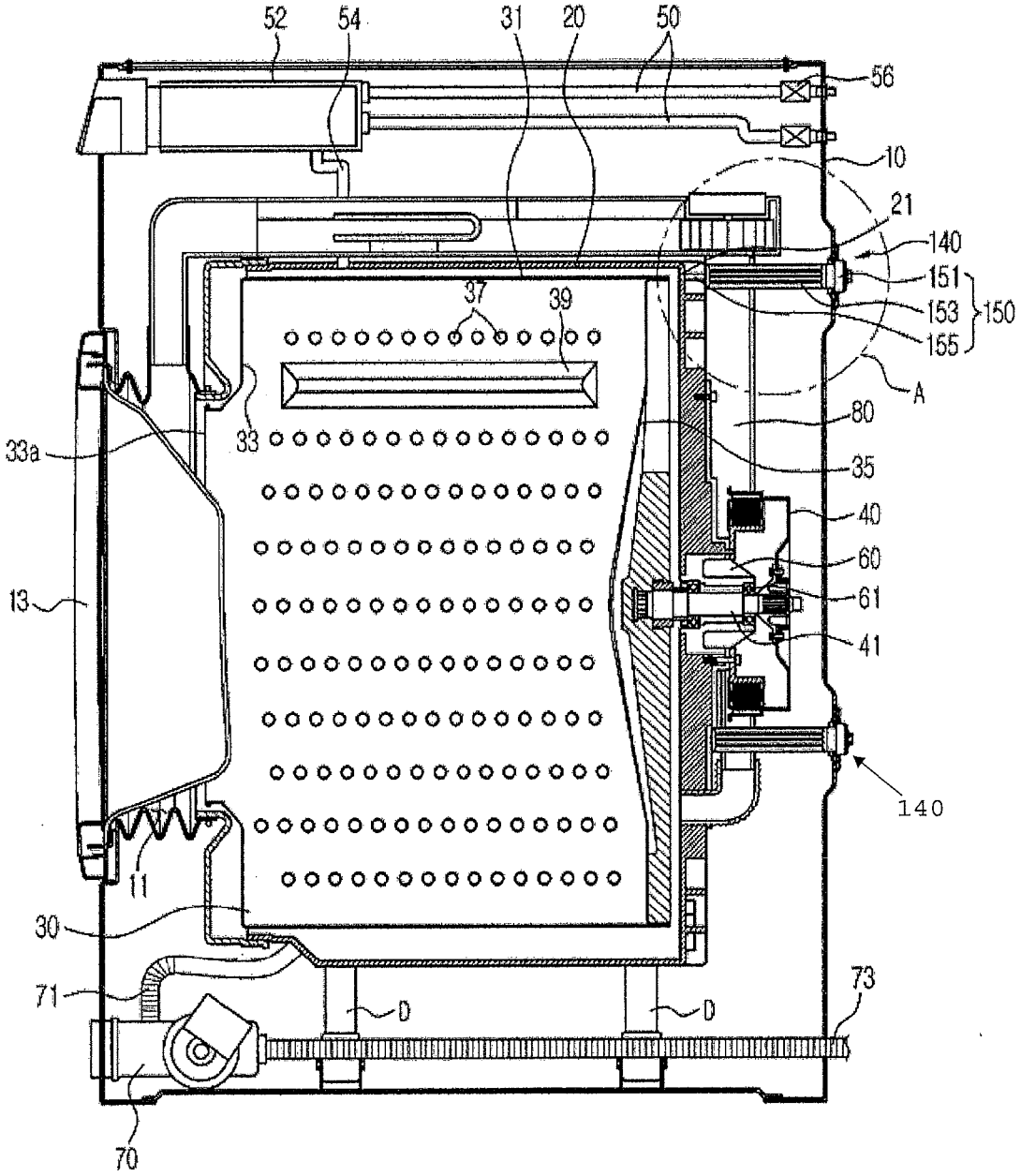
FIG. 2 is a cross-sectional view of the washing machine illustrated in FIG. 1.

As illustrated in FIGS. 1 and 2, the washing machine includes a cabinet 10 that constitutes the exterior, a tub 20 that is disposed in the cabinet 10, a drum 30 that is rotatably disposed in the tub 20, and a motor 40 that drives the drum 30.

A laundry port 11 through which laundry may be put into the drum 30 is disposed at a front side of the cabinet 10. The laundry port 11 is opened/closed by a door 13 installed at the front side of the cabinet 10.

A frame 100 that constitutes the exterior and supports vibration and shock generated while the washing machine is transported or used, is installed at both sides of the cabinet 10. A description of the frame 100 will now be provided as below.

A tub fixing part 140 that fixes the tub 20 to the cabinet 10 so that the tub may be disposed in the cabinet 10 is disposed at a rear side of the cabinet 10. A fastening hole 21 is formed in a rear wall of the tub 20 in a position corresponding to the tub fixing part 140, and the tub fixing part 140 and the fastening hole 21 are coupled to each other using a fixing member 150 so that the tub 20 may be fixed to the cabinet 10. A description of a configuration in which the tub 20 is fixed to the rear side of the cabinet 10, will now be provided as below.

A water supply pipe 50 is installed above the tub 20 and supplies washing water to the tub 20. One side of the water supply pipe 50 is connected to a water supply valve 56, and the other side of the water supply pipe 50 is connected to a detergent box 52.

The detergent box 52 is connected to the tub 20 via a connection pipe 54, and water supplied via the water supply pipe 50 is supplied into the tub 20 together with detergent via the detergent box 52.

The tub 20 is supported by a damper D, and the damper D connects an inner bottom of the cabinet 10 and an outer side of the tub 20.

The drum 30 includes a cylindrical part 31, a front panel 33 disposed at the front of the cylindrical part 31, and a rear panel 35 disposed at the rear of the cylindrical part 31.

An opening 33*a* through which laundry is put in or taken out, is formed in the front panel 33, and a driving shaft 41 that transmits power of the motor 40, is connected to the rear panel 35.

A plurality of through holes 37 through which washing water flows, are formed in a circumference of the drum 30. A plurality of lifters 39 are installed at an inner circumferential surface of the drum 30 so that laundry may be lifted or fallen when the drum 30 is rotated.

The driving shaft 41 is disposed between the drum 30 and the motor 40, one end of the driving shaft 41 is connected to the rear panel 35 of the drum 30, and the other end of the driving shaft 41 extends to an outer side of the rear wall of the tub 20.

When the motor 40 drives the driving shaft 41, the drum 30 connected to the driving shaft 41 is rotated on the driving shaft 41.

A bearing housing 60 is installed at the rear wall of the tub 20 so as to rotatably support the driving shaft 41.

The bearing housing 60 may be formed of an aluminum alloy and may be inserted into the rear wall of the tub 20 when the tub 20 is injection molded.

Bearings 61 are installed between the bearing housing 60 and the driving shaft 41 so that the driving shaft 41 may be smoothly rotated.

A drainage pump 70 that discharges water in the tub 20 toward an outer side of the cabinet 10, a connection host 71 that connects the tub 20 and the drainage pump 70 so that water in the tub 20 may flow into the drainage pump 70, and a drainage hose 73 that guides water pumped by the drainage pump 70 to the outer side of the cabinet 10, are disposed below the tub 20.

A drying apparatus 80 may be mounted on the tub 20 so as to dry air in the tub 20 and then to supply dried air into the tub 20.

A control panel 90 including a display window 91 that allows light emitted from a graphic display (not shown) to transmit so that a user may check the light, and an operating part 93 that the user selects an option so as to control an operation of the washing machine, is disposed at a front top of the cabinet 10.

The graphic display (not shown) that allows the option selected by the user to be displayed by light emitted from a plurality of light emitting diodes (LEDs) so that the user may control the operation of the washing machine, may be disposed at a rear side of the control panel 90.

Hereinafter, the frame 100 that includes beads having an improved shape to support vibration and shock of the washing machine by maintaining sufficient rigidity even though a thickness of the frame 100 is reduced, will be described in detail.

Figure 4:
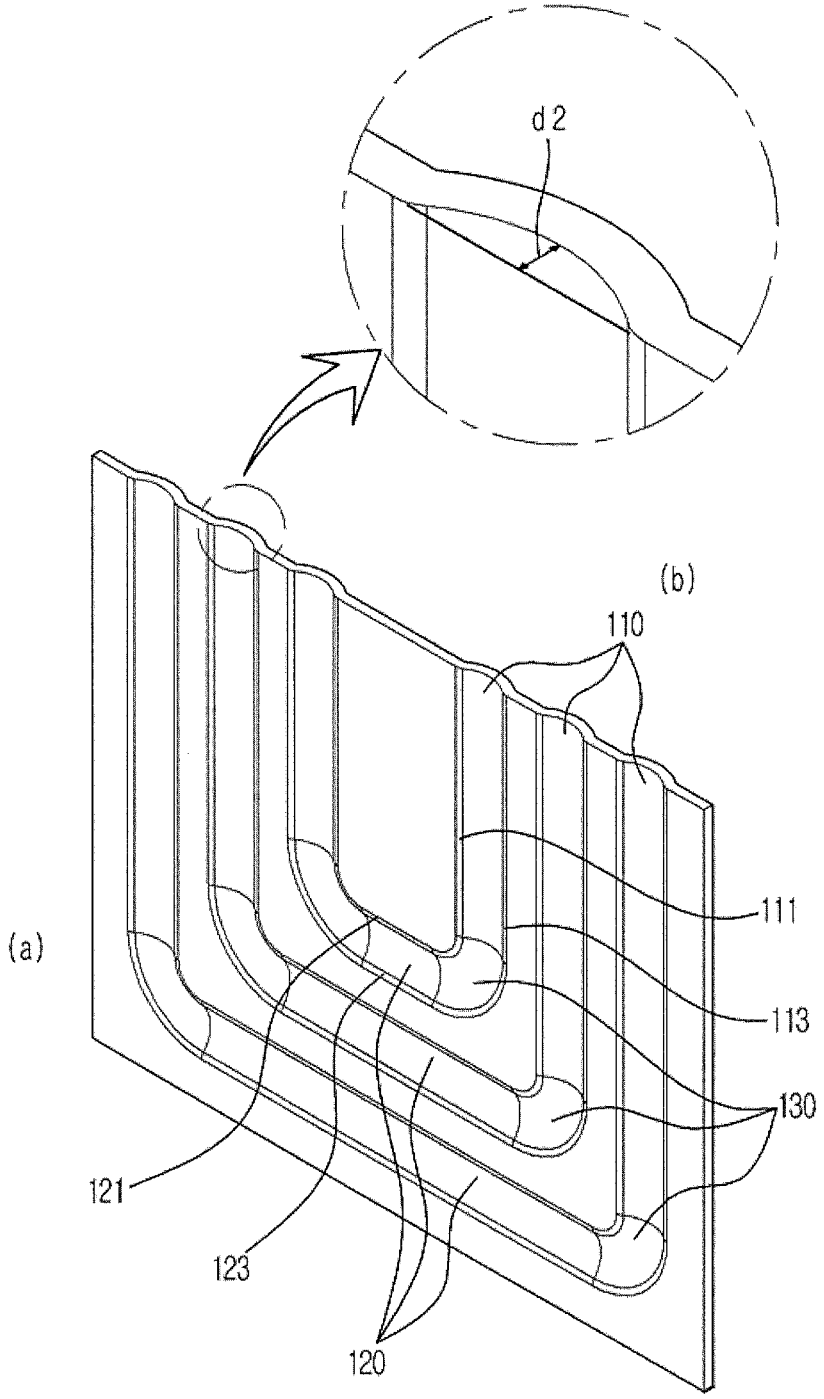
FIG. 4 is a cross-sectional view of the frame illustrated in FIG. 3.
Figure 5:
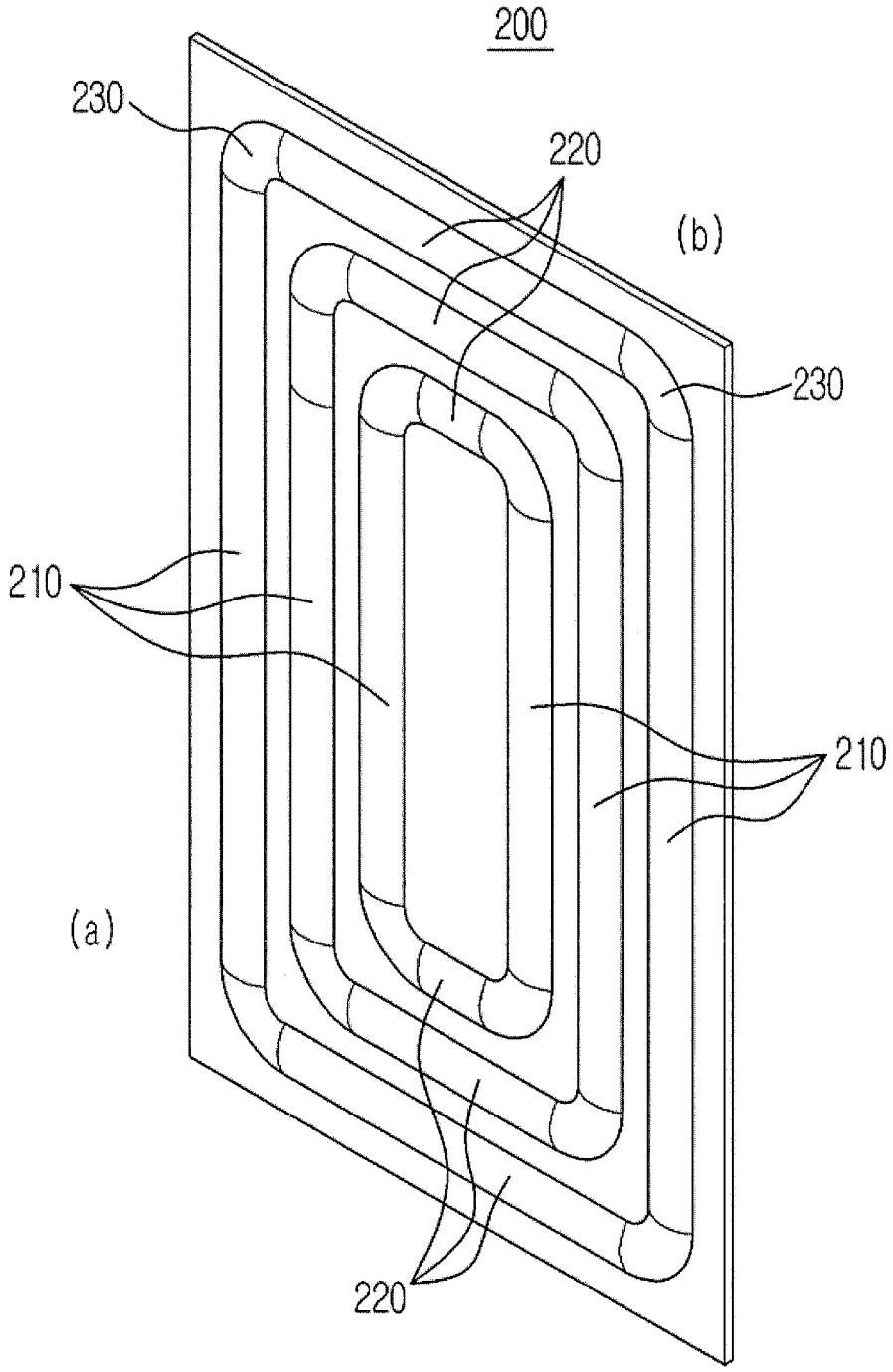
FIG. 5 is a view illustrating a frame according to another embodiment of the present invention.

Side (a) illustrated in FIGS. 4 and 5 represents an outer side of the washing machine, and side (b) of FIGS. 4 and 5 represents an inner side of the washing machine.

Figure 3:
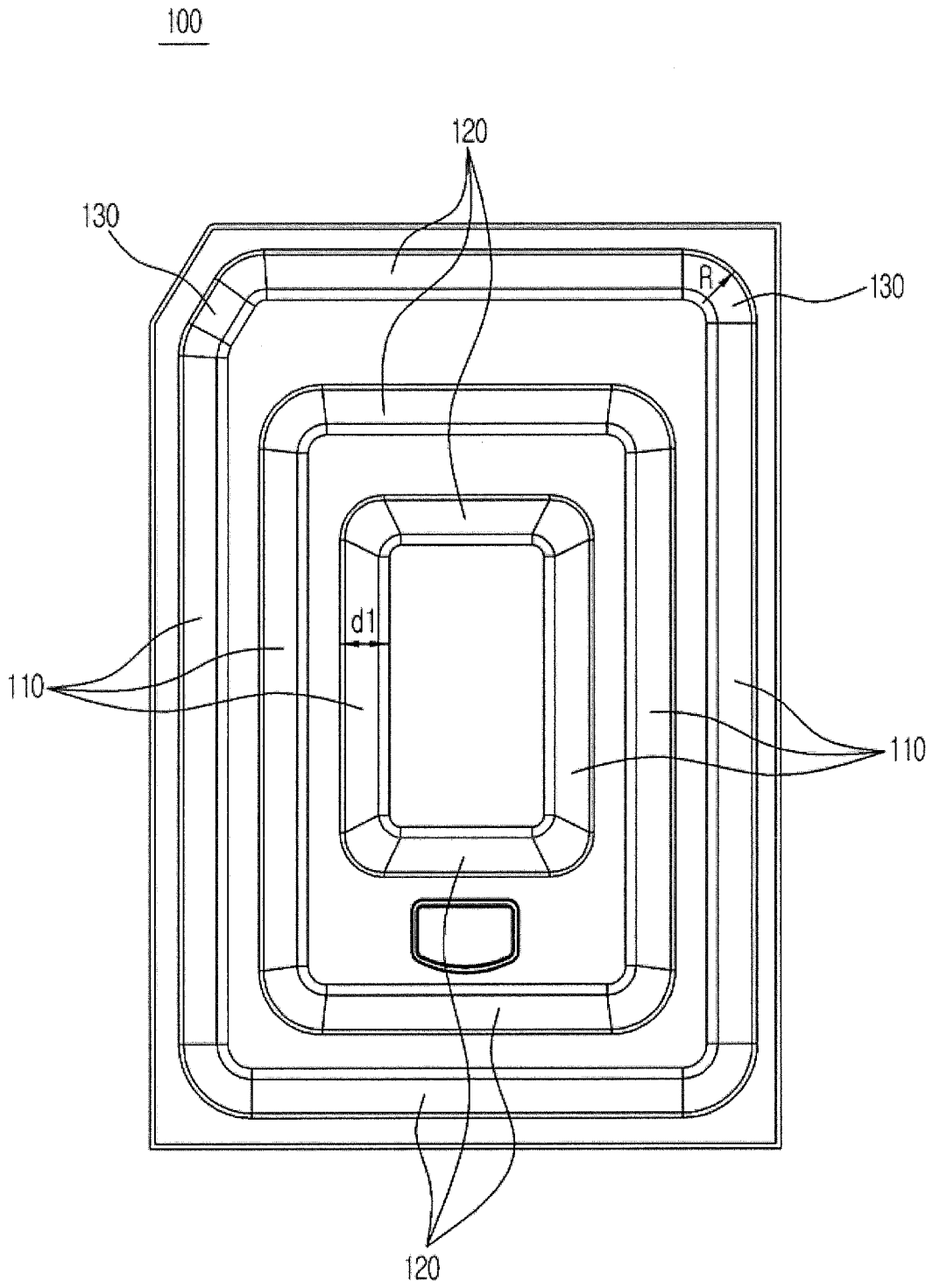
FIG. 3 is a front view illustrating a frame according to an embodiment of the present invention.

As illustrated in FIGS. 1 and 3, the frame 100 that is installed at both sides of the cabinet 10 and constitutes the exterior, includes first beads 110 that are provided in one pair while being disposed in parallel to right and left edges 115 of the frame 100, second beads 120 that are provided in one pair while being disposed in parallel to upper and lower edges 117 of the frame 100, and a connection part 130 that connects both ends of the first beads 110 and both ends of the second beads 120.

The frame 100 that is installed at both sides of the cabinet 10 constitutes the exterior and simultaneously should maintain enough rigidity to support vibration and shock generated when the washing machine operates or is transported.

The frame 100 should be disposed with enough thickness to have rigidity that may support vibration and shock of the washing machine, and the beads 110, 120, and 130 having various shapes should be disposed at the frame 100 so as to reduce the thickness of the frame 100 while maintaining rigidity that may support vibration and shock of the washing machine.

The frame 100 may be disposed to have a thickness less than 0.7 mm, for example, about 0.6 mm. The beads 110, 120, and 130 disposed at the frame 100 include the first beads 110, the second beads 120, and the connection part 130.

The first beads 110 are provided in one pair while being disposed in parallel to the right and left edges 115 of the frame 100 and have a shape of grooves formed in a direction of an inner side of the frame 100.

The first beads 110 that are disposed adjacent to the right and left edges 115 of the frame 100 in each pair, are provided in plural numbers so that the frame 100 may maintain rigidity.

The first beads 110 provided in plural numbers are disposed so that their lengths may gradually decrease from portions adjacent to the right and left edges 115 of the frame 100 toward the center of the frame 100.

In the drawings, three first beads 110 are disposed at the right and left edges 115 of the frame 100 in each pair. However, aspects of the present invention are not limited thereto, and two or less or four or more first beads 110 may be disposed.

As illustrated in FIG. 4, the grooves of the first beads 110 may have a width d1 (see FIG. 3) of 8 mm or more and a semicircular shape with a depth d2, of which a center is the deepest. In order for the frame 100 to have sufficient rigidity, the center of the grooves may have a depth of 4.0 to 10.0 mm, a depth of about 6 mm, so as to have a depth that is about 8 to 10 times the thickness of the frame 100.

The second beads 120 are provided in one pair while being disposed in parallel to the upper and lower edges 117 of the frame 100 and have grooves formed in the direction of the inner side of the frame 100, like in the first beads 110.

The second beads 120 are provided in plural numbers so that the frame 100 may maintain rigidity, like in the first beads 110.

The second beads 120 provided in plural numbers are disposed so that their lengths may gradually decrease from portions adjacent to the upper and lower edges 117 of the frame 100 toward the center of the frame 100.

In the drawings, three second beads 120 are disposed at the upper and lower edges 117 of the frame 100 in each pair. However, aspects of the present invention are not limited thereto, and two or less or four or more second beads 120 may be disposed.

The groove shape, width, and depth of the second beads 120 are the same as those of the first beads 110 and thus descriptions thereof will be omitted.

Stepped parts 111, 113, 121, 123, 131, and 133 may be disposed at boundaries between the beads 110, 120, and 130 so as to prevent rigidity of the frame 100 from being deteriorated due to a rapid depth variation from the surface of the frame 100.

Both ends of the first beads 110 and both ends of the second beads 120 are connected to each other by the connection part 130, and the connection part 130 is provided in a round form so that a concentrated load may not be generated in the connection part 130.

The connection part 130 has a shape of grooves formed in the direction of the inner side of the frame 100, like in the first beads 110 and the second beads 120, and the groove shape, width, and depth of the connection part 130 are the same as those of the first beads 110 and the second beads 120, and thus descriptions thereof will be omitted.

The beads 110, 120, and 130 including the first beads 110, the second beads 120, and the connection part 130 are arranged at the frame 100 in a rectangular form. Since the beads 110, 120, and 130 are provided in plural numbers, from a point of the whole frame 100, lengths of the first beads 110 and the second beads 120 decrease as the plurality of beads 110, 120, and 130 get closer to the center of the frame 100 from the outer side of the frame 100.

Hereinafter, results of testing rigidity and twisting quantity by using a structure of the frame 100 disposed at both sides of the frame 100 according to the present invention and an existing frame structure will be described.

The existing frame structure is a structure in which separated beads are arranged in the form of a straight line.

The following represents results of testing rigidity using a cabinet including a bead structure according to the present invention and an existing cabinet structure.

A1 represents measurement of a degree at which frames to which the bead structure is applied vibrate in the same direction with respect to a natural vibration frequency of the cabinet, A2 represents measurement of a degree at which the frames to which the bead structure is applied vibrate in opposite directions, B1 represents measurement of a degree of vibration of upper edges of the frames, and B2 represents measurement of a degree of vibration of centers of the frames.

TABLE 1

| Classification | | Cabinet including existing bead structure | Cabinet including bead structure according to the present invention |
|---|---|---|---|
| Natural vibration frequency | A1 | 22.5 Hz | 24.1 Hz |
| | A2 | 22.3 Hz | 25.1 Hz |
| Vibration degree | B1 | 0.25 mm | 0.23 mm |
| | B2 | 1.62 mm | 0.80 mm |

As shown in the above Table 1, in case of a natural vibration frequency A1, the natural vibration frequency increases by 7% compared to the cabinet including the existing structure, and in case of a natural vibration frequency A2, the natural vibration frequency increases by 12.5% compared to the cabinet including the existing structure. That is, less vibration occurs than in the existing frames.

In case of B1 with respect to a vibration degree, the vibration degree decreases by 8%, and in case of B2, the vibration degree decreases by 51%. Thus, a degree at which the cabinet vibrates, decreases.

The following represents results of testing a degree of twisting when the cabinet is formed.

TABLE 2

| Classification | | Cabinet including existing bead structure | Cabinet including bead structure according to the present invention |
|---|---|---|---|
| Twisting quantity | + displacement | +13.2 mm | +7.1 mm |
| | − displacement | −8.5 mm | −5.6 mm |
| | Total displacement quantity | 21.7 mm | 12.7 mm |

In case of + displacement with respect to a twisting quantity, the twisting quantity decreases by 46% compared to the cabinet including the existing structure. In case of − displacement with respect to the twisting quantity, the twisting quantity decreases by 34% compared to the cabinet including the existing structure. Thus, in case of total displacement quantity including + displacement and − displacement, the twisting quantity decreases by 42% compared to the cabinet including the existing structure. That is, a degree of twisting that occurs when the cabinet is formed, decreases compared to the existing cabinet structure. When patterns according to the present invention are applied in this way, the twisting quantity decreases when the cabinet vibrates or is formed. Thus, a cabinet of the washing machine may be manufactured using material having a thickness less than 0.7 mm, unlike in the related art.

Figure 6:
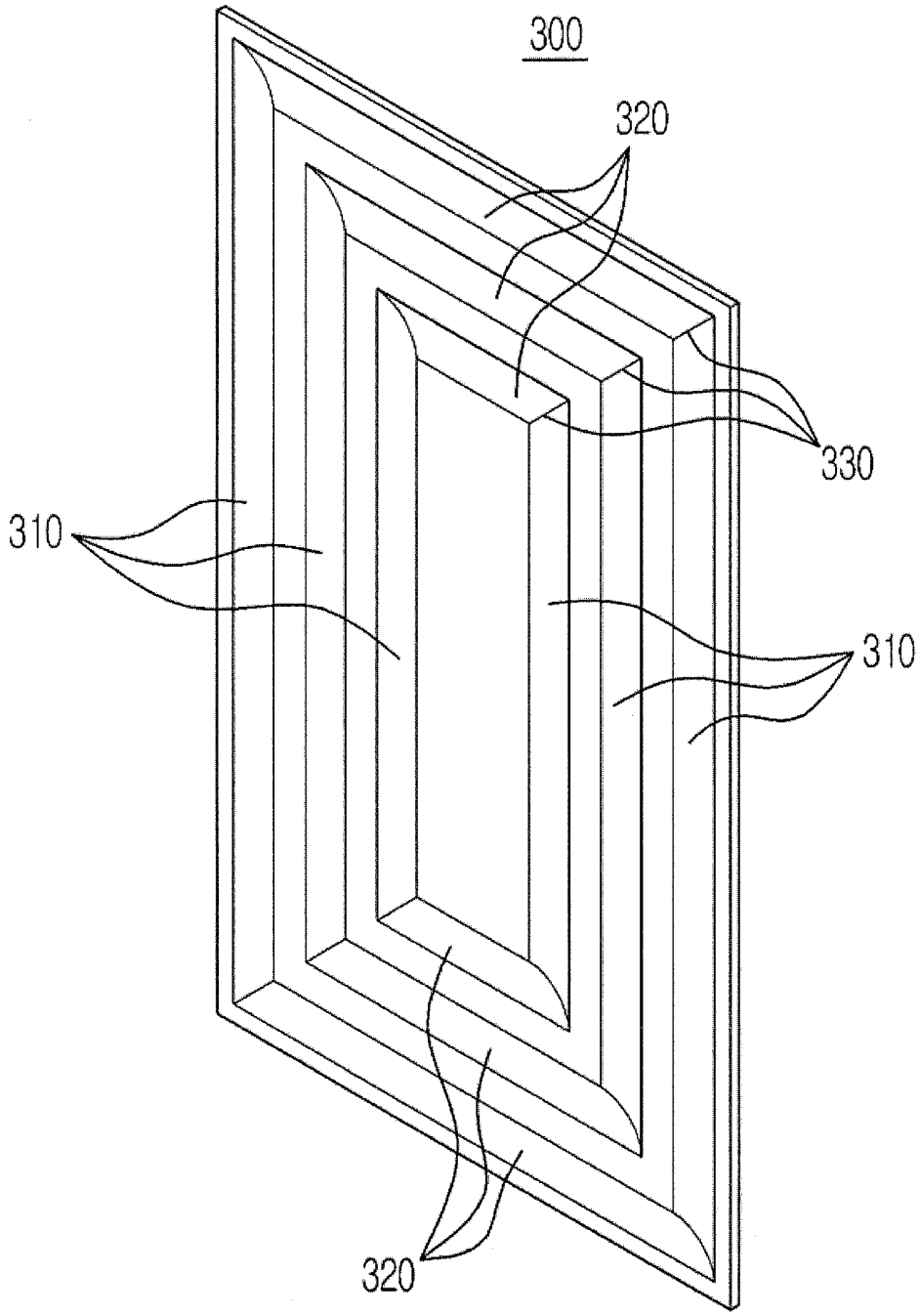
FIG. 6 is a view illustrating a frame according to another embodiment of the present invention.
Figure 7:
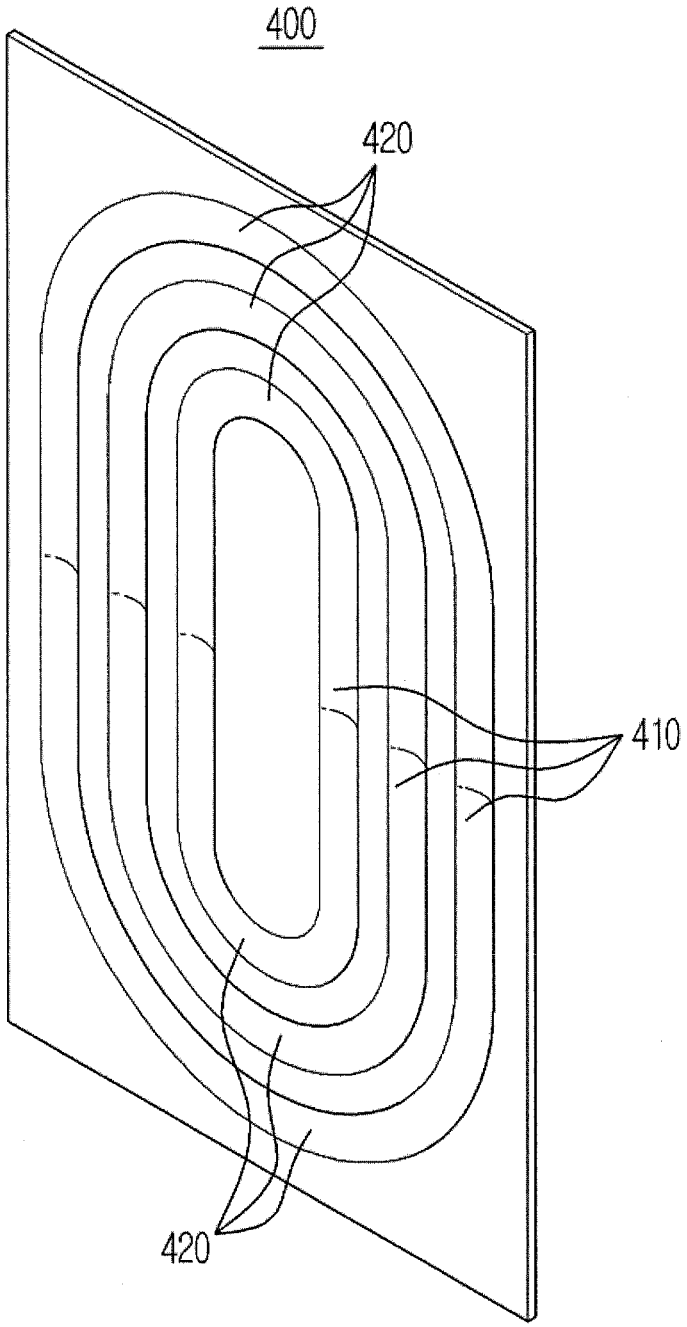
FIG. 7 is a view illustrating a frame according to another embodiment of the present invention.

FIGS. 5 through 7 illustrate various embodiments of beads disposed at frames 200, 300, and 400. As illustrated in FIG. 5, the frame 200 includes beads 210, 220, and 230. The beads 210, 220, and 230 include first beads 210, second beads 220, and a connection part 230 and have a shape in which the beads 210, 220, and 230 protrude from an outer side of the frame 200.

The beads 210, 220, and 230 illustrated in FIG. 5 have the same shape, width, and depth as those of the beads 110, 120, and 130 illustrated in FIG. 1 and FIGS. 3 and 4 except that the beads 110, 120, and 130 of FIG. 1 and FIGS. 3 and 4 have a shape of grooves formed in the inner side of the frame 100, whereas the beads 210, 220, and 230 of FIG. 5 protrude from the outer side of the frame 200. Thus, descriptions thereof will be omitted.

As illustrated in FIG. 6, the frame 300 may include beads 310 and 320 including first beads 310 and second beads 320. Each of the first beads 310 and each of the second beads 320 may be directly connected to each other without the configuration of a connection part so that corners 330 may be formed.

The first beads 310 and the second beads 320 excluding the configuration of the connection part are the same as in the above embodiments and thus descriptions thereof will be omitted.

As illustrated in FIG. 7, the frame 400 includes a plurality of first beads 410. The plurality of first beads 410 that are disposed at right and left sides of the frame 400 in each pair may be connected to each other by a curve part 420 and may be arranged at the frame 400 in an oval form.

Hereinafter, a configuration in which the tub 20 is fixed to the rear side of the cabinet 10 will be described in detail.

As illustrated in FIG. 2 and FIGS. 8 through 10, the tub fixing part 140 for fixing the tub 20 is disposed at the rear side of the cabinet 10, the fastening hole 21 is formed in the rear wall of the tub 20 in a position corresponding to the tub fixing part 140, and the fixing member 150 that is inserted into the tub fixing part 140 from the outer side of the cabinet 10 is fastened in the fastening hole 21 so that the tub 20 may be fixed to the cabinet 10.

The tub fixing part 140 that is disposed at the rear side of the cabinet 10, includes a circular hole 141 into which the fixing member 150 is inserted, protrusion beads 143 that are disposed adjacent to the hole 141 along a circumference of the hole 141, and reinforcement grooves 145 that are disposed in a direction of a radius of the hole 141 from the hole 141 toward the outer side of the hole 141.

The cabinet 10 constitutes the exterior and simultaneously requires sufficient rigidity to support vibration and shock generated when the washing machine operates or is transported.

In particular, the hole 141 formed in the rear side of the cabinet 10 so as to fix the tub 20, is very likely to be deformed by the fixing member 150 that is shaken due to vibration and shock, and deformation may occur in the rear side of the cabinet 10 due to deformation of a periphery of the hole 141.

The protrusion beads 143 are disposed adjacent to the hole 141 along the circumference of the hole 141 so as to prevent deformation of the periphery of the hole 141 due to the fixing member 150.

The protrusion beads 143 are disposed to protrude from a rear outer side of the cabinet 10 convexly, and a convexly-protruding portion of the protrusion beads 143 has a round shape.

A portion of the protrusion beads 143 adjacent to the hole 141 and the hole 141 may be connected to each other by an obliquely inclined surface having a round shape.

Deformation of the periphery of the hole 141 that occurs due to the fixing member 150 may be prevented by the protrusion beads 143 that protrude from the outer side of the cabinet 10 convexly. The thickness of the cabinet 10 needs to be reduced while the cabinet 10 maintains rigidity to support vibration and shock of the washing machine so as to reduce costs.

The cabinet 10 is disposed to have a reduced thickness of about 0.6 mm. Due to the reduced thickness of the cabinet 10, it is difficult to prevent deformation caused by the fixing member 150 that is shaken due to vibration and shock of the washing machine by using only the protrusion beads 143 disposed at the periphery of the hole 141.

In order to prevent deformation of the periphery of the hole 141 that occurs due to the reduced thickness of the cabinet 10, the reinforcement grooves 145 are disposed at the tub fixing part 140.

The reinforcement grooves 145 extend from the hole 141 toward the outer side of the hole 141 in the direction of the radius of the hole 141 up to the outer side of the protrusion beads 143 and have a shape of grooves with the same depths.

Depths of the reinforcement grooves 145 are not limited to be the same but may be different according to the shape of the protrusion beads 143 in which the reinforcement grooves 145 are formed.

The reinforcement grooves 145 that extend from the hole 141 to the outer side of the protrusion beads 143 are provided in plural numbers in a radial form around the hole 141.

Since the plurality of reinforcement grooves 145 have the radial form along the circumference of the hole 141 so as to reinforce all portions of the periphery of the hole 141, the periphery of the hole 141 may be prevented from being deformed by a shake of the fixing member 150.

Figure 11:
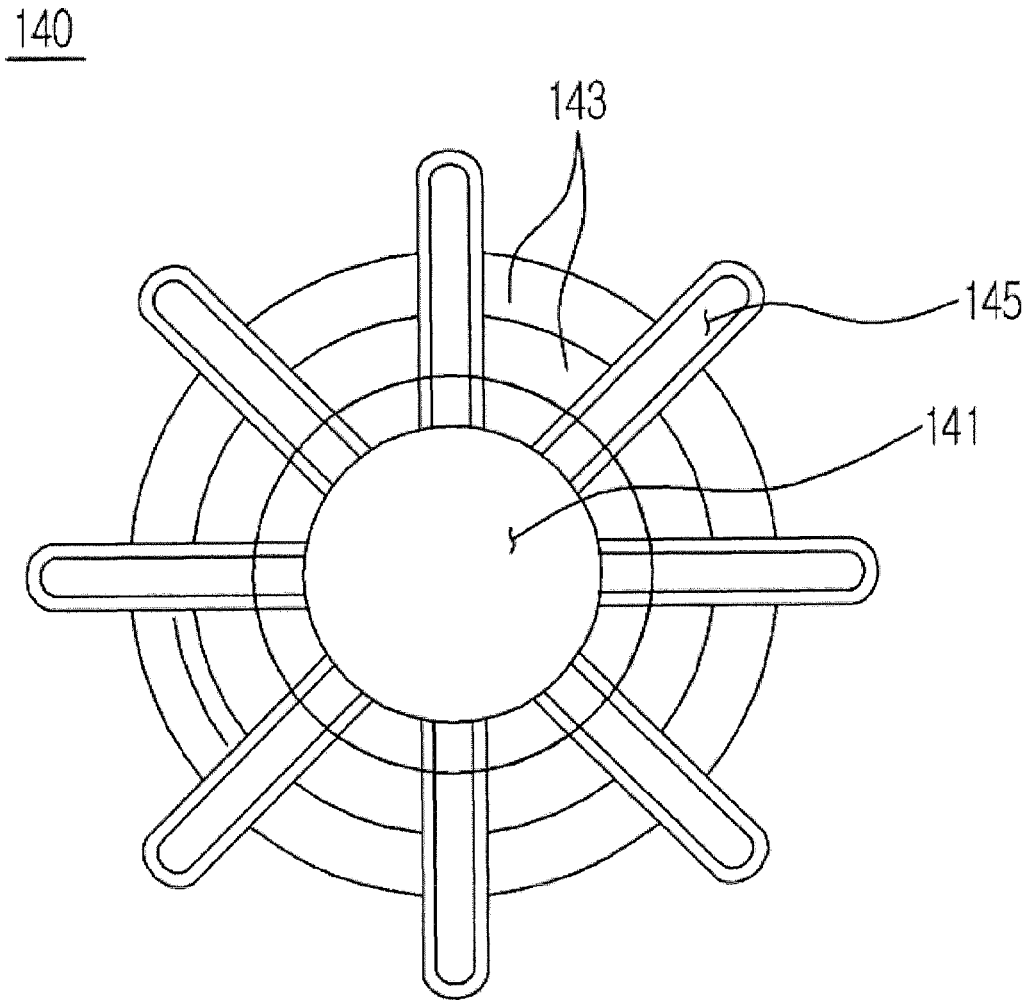
FIG. 11 is a view illustrating a case that two protrusion beads are formed at the tub fixing part of FIG. 10.

Two protrusion beads 143 may be provided, as illustrated in FIG. 11. Although not shown, two or more protrusion beads 143 may be provided.

In the drawings, eight reinforcement grooves 145 with the same intervals are provided. However, aspects of the present invention are not limited thereto, and eight or more or less reinforcement grooves 145 may be disposed, and their intervals may also be different depending on an occasion.

Figure 12:
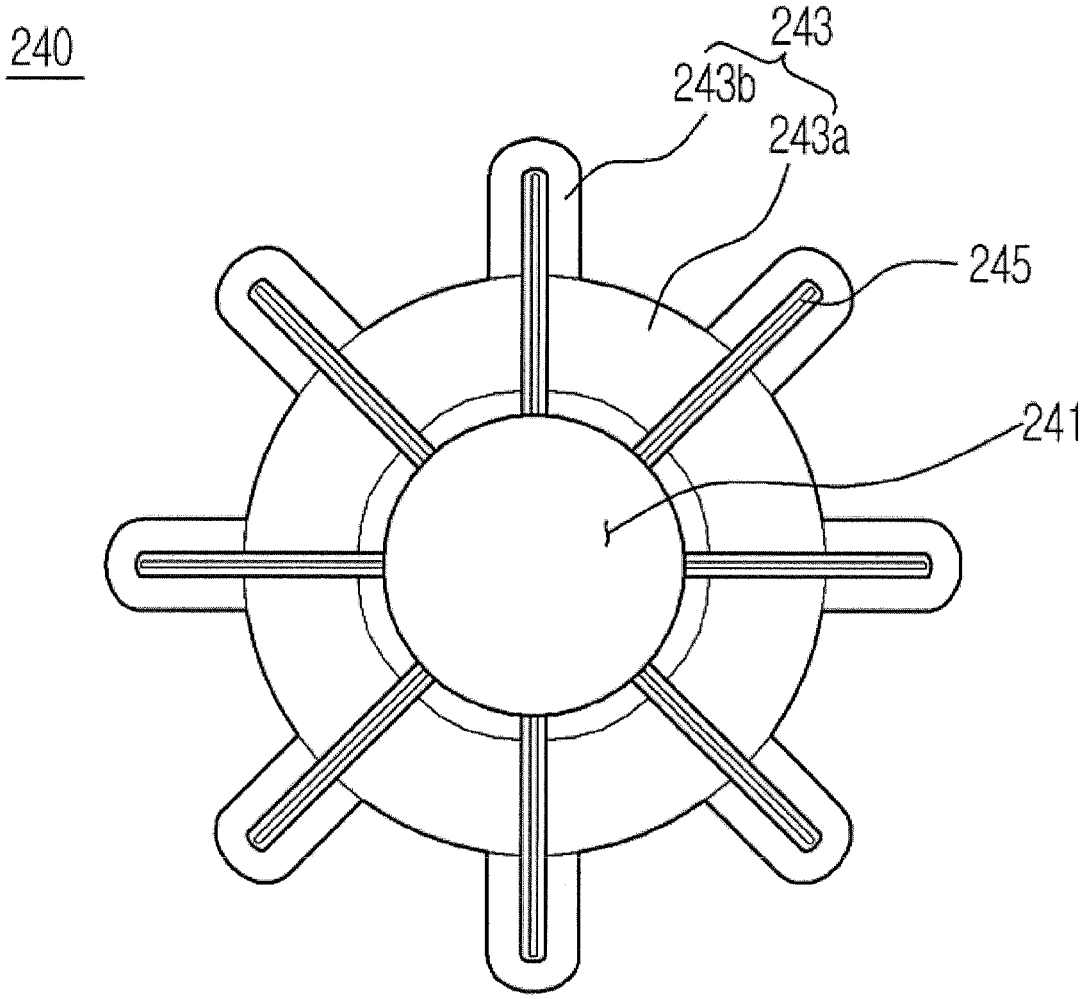
FIG. 12 is a plan view illustrating a tub fixing part according to another embodiment of the present invention.

FIG. 12 illustrates a tub fixing part 240 disposed at the rear side of the cabinet 10, according to another embodiment of the present invention.

The tub fixing part 240 includes a circular hole 241 into which the fixing member 150 is inserted, a circular bead 243*a* and radial beads 243*b* that are disposed adjacent to the hole 241 along a circumference of the hole 241, and reinforcement grooves 245 that are disposed in a direction of a radius of the hole 241 from the hole 241 toward an outer side of the hole 241.

The circular bead 243*a* is disposed adjacent to the hole 241 along the circumference of the hole 241, a plurality of radial beads 243*b* are disposed in a radial form toward an outer side of the circular bead 243*a*, and the circular bead 243*a* and the radial beads 243*b* protrude from a rear outer side of the cabinet 10 convexly.

The reinforcement grooves 245 extend from the hole 241 to the outer side of the hole 241 up to the radial beads 243*b*, and a plurality of reinforcement grooves 245 corresponding to the number of the radial beads 243*b* are provided.

Since a plurality of radial beads 243*b* and a plurality of reinforcement grooves 245 are disposed to have a radial structure along the circumference of the hole 241 so as to reinforce all portions of the periphery of the hole 241, the periphery of the hole 241 may be prevented from being deformed by a shake of the fixing member 150.

In the drawings, eight radial beads 243*b* with the same intervals are provided. However, aspects of the present invention are not limited thereto, and eight or more or less radial beads 243*b* may be disposed, and their intervals may also be different depending on an occasion.

Figure 8:
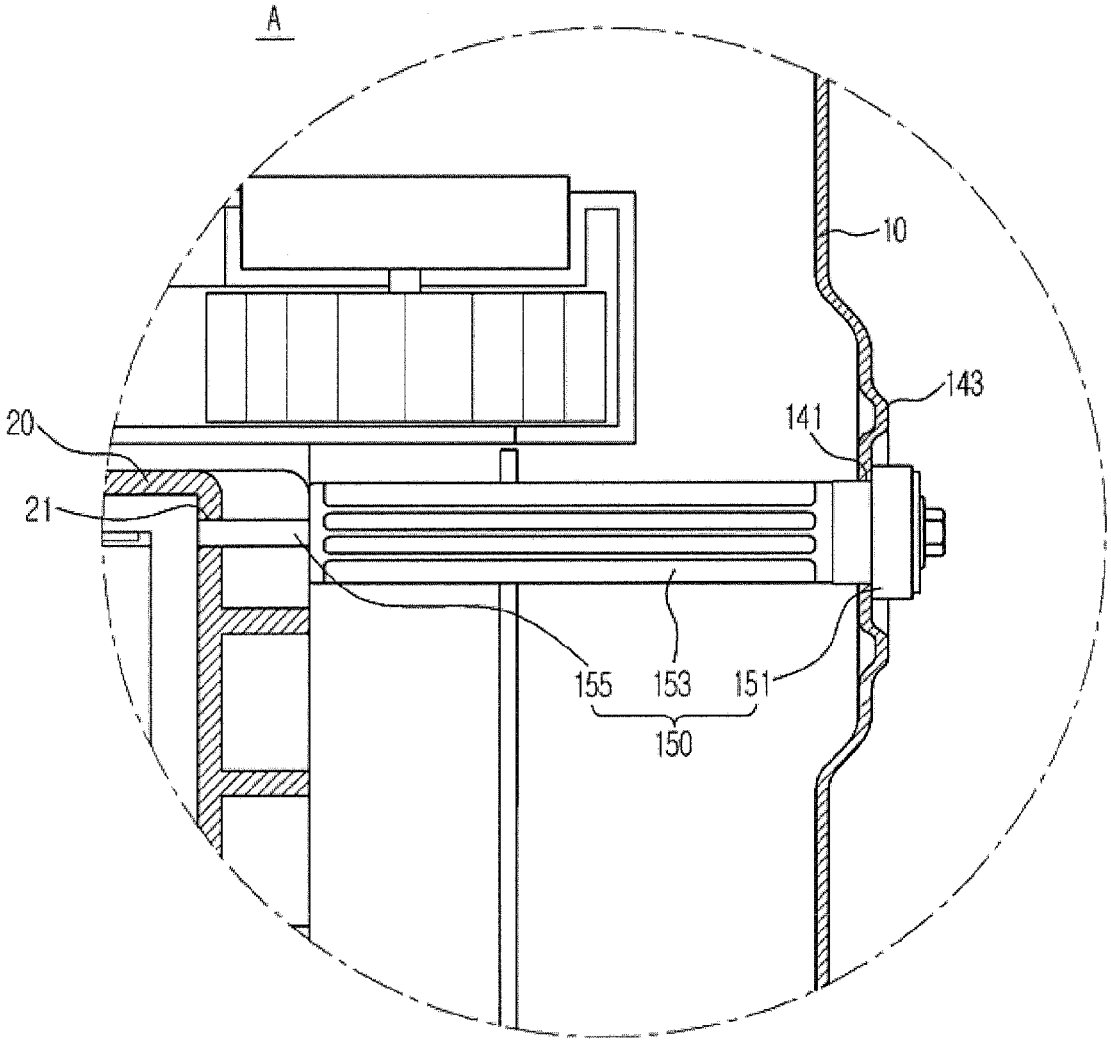
FIG. 8 is an enlarged view of a portion A of FIG. 2.
Figure 9:
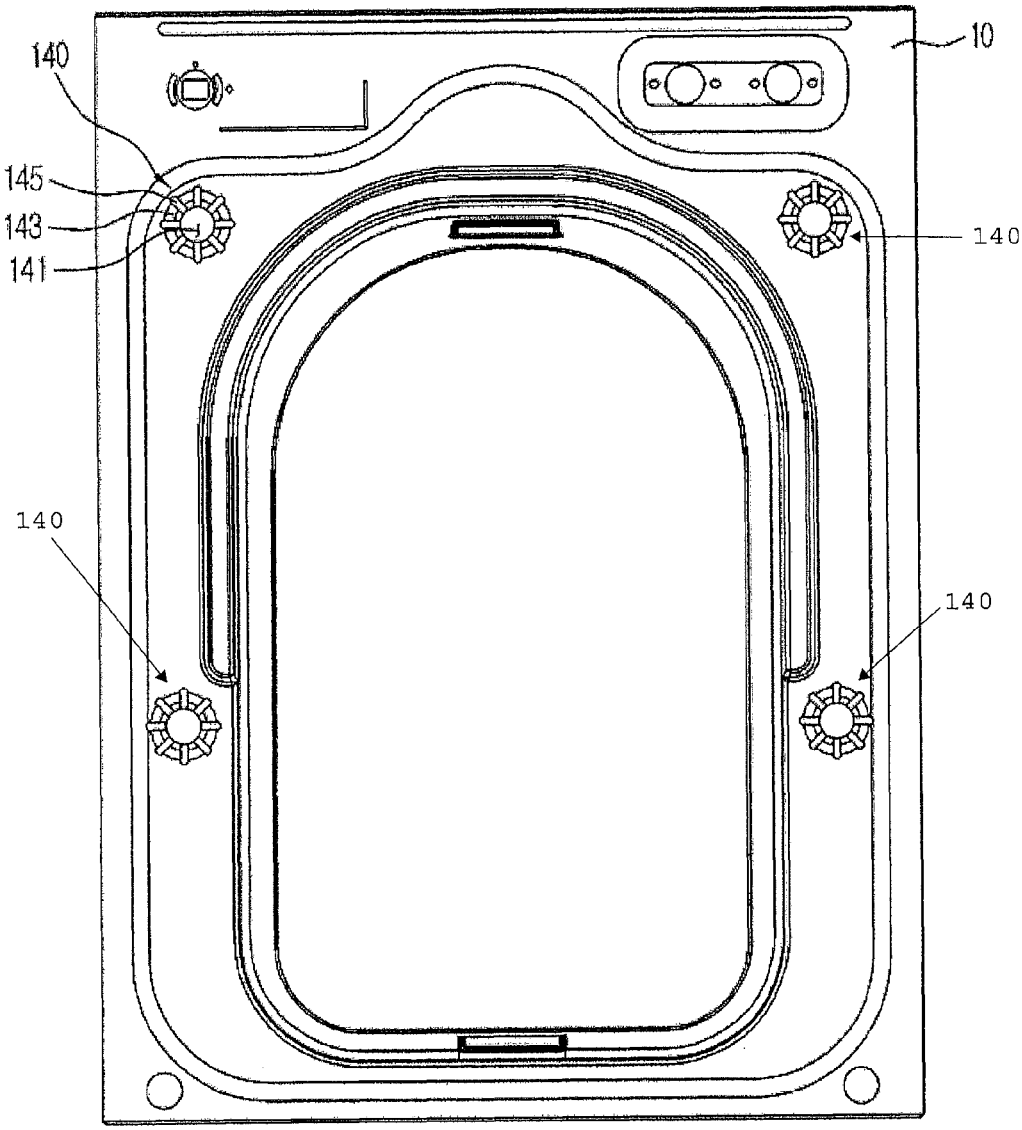
FIG. 9 is a view illustrating a rear side of a cabinet according to an embodiment of the present invention.
Figure 10:
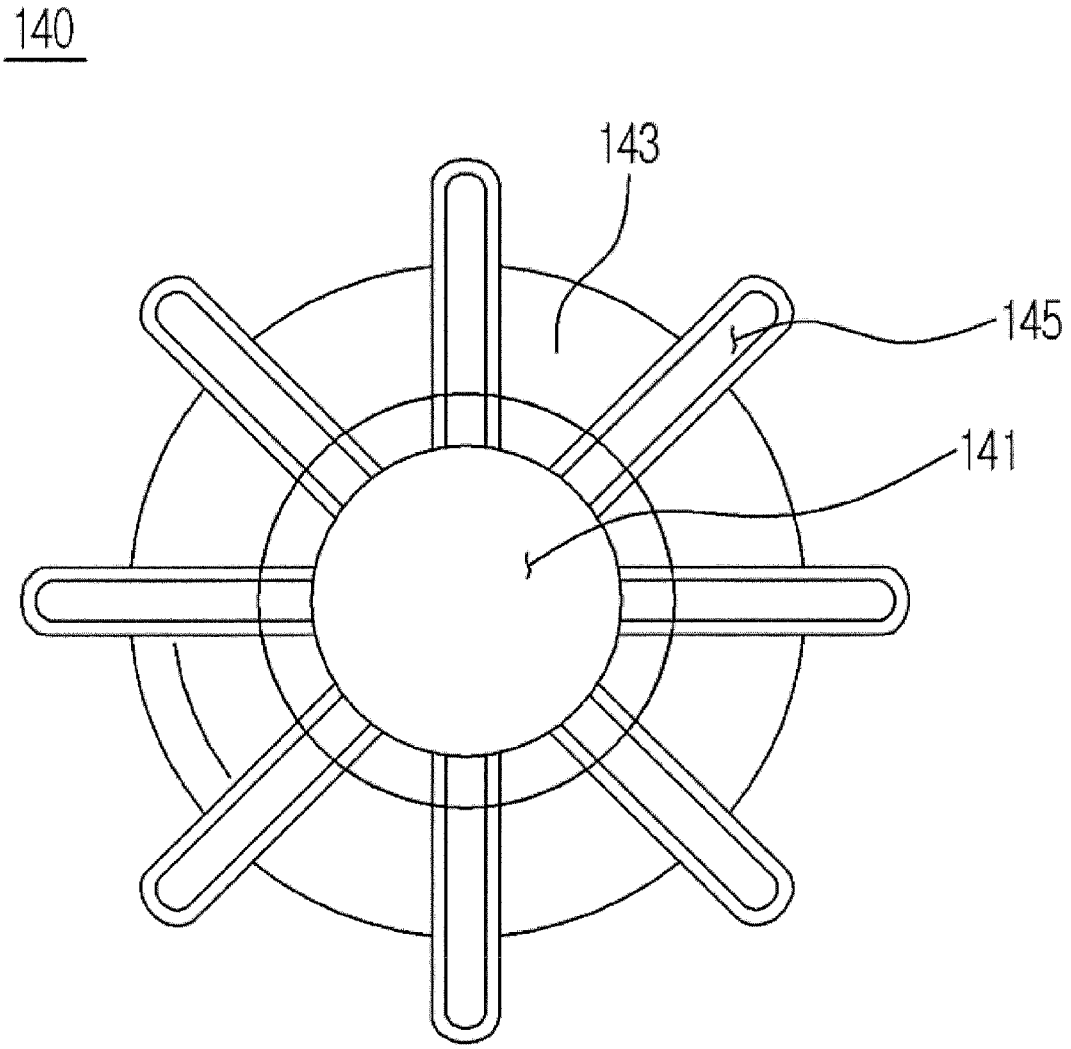
FIG. 10 is a plan view of a tub fixing part illustrated in FIG. 9.
Figure 13:
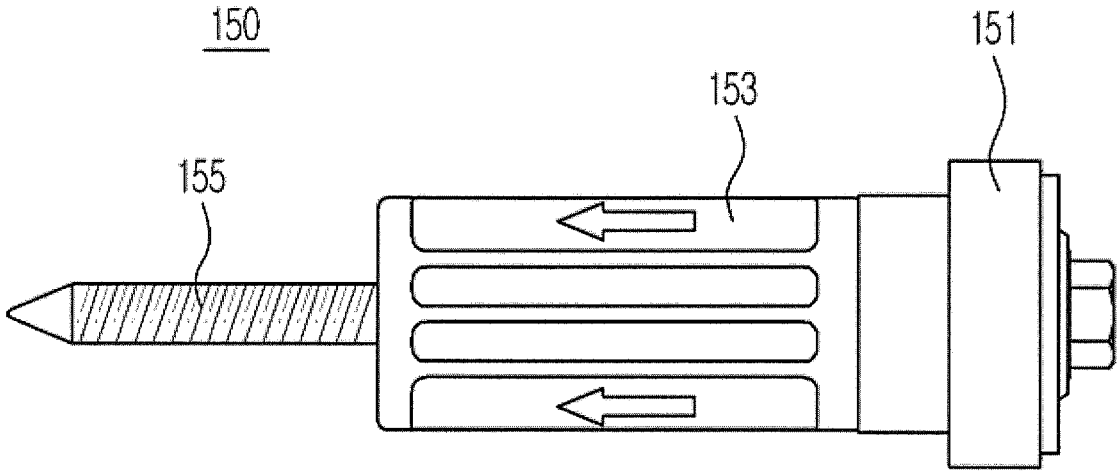
FIG. 13 is a view illustrating a fixing member according to an embodiment of the present invention.

As illustrated in FIGS. 8 and 13, the fixing member 150 includes a head 151 that is disposed to have a larger diameter than a diameter of the hole 141 or 241 so that the fixing member 150 may not be inserted into the hole 141 or 241, the head 151 being fixed to the hole 141 or 241, a body 153 that is disposed at a front side of the head 151 to have a diameter corresponding to the hole 141 or 241 and is inserted into the hole 141 or 241, and a fastening part 155 that is disposed at a front side of the body 153 and is fastened in a fastening hole 21 disposed in a rear wall of the tub 20.

A screw thread may be disposed at the fastening part 155 of the fixing member 150 and the fastening hole 21 formed in the rear wall of the tub 20 so that the fastening part 155 of the fixing member 150 and the fastening hole 21 may be screw-coupled to each other.

As described above, according to the embodiments of the present invention, the thickness of the frame is reduced and component costs are reduced so that cost competitiveness can be improved, and the weight of the frame is reduced so that transportation conditions can be improved.

Also, rigidity of the tub fixing part disposed at a rear side of the cabinet is reinforced so that the tub fixing part can be prevented from being deformed by vibration and shock of the washing machine.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet that constitutes an exterior of the washing machine;

a tub that is disposed to accommodate washing water in the cabinet and has a fastening hole formed in a side of the tub;

a tub fixing part formed on a wall of the cabinet in a position corresponding to the fastening hole; and a fixing member that is inserted into the tub fixing part and is fastened to the fastening hole so that the tub is fixed to the cabinet, wherein the tub fixing part comprises a circular hole into which the fixing member is inserted, a protrusion bead that is disposed adjacent to the circular hole along a circumference of the circular hole and a plurality of reinforcement grooves that prevent the circular hole from being deformed and disposed to extend from the circular hole toward an outer side of the circular hole in a direction of a radius of the circular hole around the circular hole.

2. The washing machine according to claim 1, wherein the fixing member comprises a head that is disposed to have a larger diameter than a diameter of the circular hole so that the head is not inserted into the circular hole, the head being fixed to an outside portion of the circular hole, a body that is disposed at a front side of the head to have a diameter corresponding to the circular hole and is inserted into the circular hole, and a fastening part that is disposed at a front side of the body and is fastened in the fastening hole disposed in the side of the tub.

3. The washing machine according to claim 1, wherein a convexly-protruding portion of the protrusion bead has a round-shaped cross-section and the protrusion bead and the circular hole are connected by an obliquely inclined surface having a round-shaped cross-section.

4. The washing machine according to claim 1, wherein the reinforcement grooves extend up to an outer side of the protrusion bead and have a same depth as the protrusion bead.

5. A washing machine comprising:

a cabinet that constitutes an exterior of the washing machine;

a tub that is disposed to accommodate washing water in the cabinet and has a fastening hole formed in a side of the tub;

a tub fixing part formed on a wall of the cabinet in a position corresponding to the fastening hole; and a fixing member that is inserted into the tub fixing part and is fastened to the fastening hole so that the tub is fixed to the cabinet, wherein the tub fixing part comprises a circular hole into which the fixing member is inserted, a circular bead that is disposed adjacent to the circular hole along a circumference of the circular hole and protrudes from an outer side of the cabinet convexly, a radial bead that is provided in a radial form around the circular hole toward an outer side of the circular bead and protrudes from the outer side of the cabinet convexly, and a plurality of reinforcement grooves that prevent the circular hole from being deformed and are disposed to extend from the circular hole toward an outer side of the circular hole in a direction of a radius of the circular hole around the circular hole.

6. The washing machine according to claim 5, wherein the fixing member comprises a head that is disposed to have a larger diameter than a diameter of the circular hole so that the head is not inserted into the circular hole, the head being fixed to an outside portion of the circular hole, a body that is disposed at a front side of the head to have a diameter corresponding to the circular hole and is inserted into the circular hole, and a fastening part that is disposed at a front side of the body and is fastened in the fastening hole disposed in the side of the tub.

7. The washing machine according to claim 5, wherein a convexly-protruding portion of the circular bead has a round-shaped cross-section and the circular bead and the circular hole are connected by an obliquely inclined surface having a round-shaped cross-section.

8. The washing machine according to claim 5, wherein the plurality of reinforcement grooves extend up to an outer side of the circular bead and have a same depth as the circular bead.

* * * * *